US006422838B1

(12) United States Patent
Sloteman

(10) Patent No.: US 6,422,838 B1
(45) Date of Patent: Jul. 23, 2002

(54) TWO-STAGE, PERMANENT-MAGNET, INTEGRAL DISK-MOTOR PUMP

(75) Inventor: Donald P. Sloteman, New Hope, PA (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 09/615,509

(22) Filed: Jul. 13, 2000

(51) Int. Cl.[7] ..... F04B 17/00; F04B 35/00; F04B 3/00; F04B 25/00; F04B 3/02

(52) U.S. Cl. ..... 417/423.5; 417/423.8; 417/366; 417/244; 417/246; 417/247; 415/144; 415/101; 415/102

(58) Field of Search ..... 417/423.5, 423.8, 417/366, 244, 246, 247; 415/144, 101, 102

(56) References Cited

U.S. PATENT DOCUMENTS 2,700,343 A * 1/1955 Pezzillo, Jr. ..... 417/423.5
2,752,857 A 7/1956 White
3,143,103 A * 8/1964 Zuhn ..... 415/144
4,105,372 A * 8/1978 Mishina et al. ..... 417/244
4,806,080 A 2/1989 Mizobuchi et al.
5,158,440 A 10/1992 Cooper et al.
5,332,374 A 7/1994 Kricker et al.
5,567,133 A * 10/1996 Kobayashi et al. ..... 417/423.7
5,797,731 A * 8/1998 Kobayashi et al. ..... 417/423.5
6,012,909 A 1/2000 Sloteman et al.
6,155,802 A * 12/2000 Choi et al. ..... 417/366
6,193,473 B1 * 2/2001 Mruk et al. ..... 417/423.5

* cited by examiner

*Primary Examiner*—Louis J. Casaregola
*Assistant Examiner*—Timothy P. Solak
(74) *Attorney, Agent, or Firm*—Killworth, Gottman, Hagan & Schaeff, L.L.P.

(57) ABSTRACT

A two-stage, permanent-magnet, integral disk-motor centrifugal pump, has a housing having first and second suction ports and first and second discharge ports, the first discharge port being connected to the second suction port. A first impeller is rotatably disposed on a shaft between the first suction port and the first discharge port and a second impeller is placed back-to-back with the first impeller and rotatably disposed on a shaft between the second suction port and the second discharge port, each of the first and second impellers having a back shroud with an array of permanent magnets fixed thereto. A first stator and a second stator are interposed between and adjacent to the first and second impellers, respectively, the rotational speed of the impellers being controlled by invertors acting upon the stators. Provisions are also included for extracting motor heat from the pump.

10 Claims, 4 Drawing Sheets

TWO-STAGE, PERMANENT-MAGNET, INTEGRAL DISK-MOTOR PUMP

BACKGROUND OF THE INVENTION

This invention relates generally to centrifugal pumps and more particularly to multi-stage centrifugal pumps with integral disk-motors.

The practice is well established for integrating disk motors, particularly permanent-magnet, brushless DC motors, into centrifugal pumps. This is particularly focused on single-stage pumping machinery. The prior art teaches not only the configuration of the disk motor integrated with the pump but also the axial bearing and rotor position sensor configurations, double-suction design, motor cooling, and assembly/disassembly features.

Head generation and flow delivery for disk motor pumps is limited by the amount of torque which the motor, at a given diameter, can develop. The total head generated is a function of the rotor diameter and its rotation speed. The flow delivery for a given diameter and speed is determined by the impeller width. The speed of rotation is limited by both the frequency limitations of the inverter used to drive the motor and the NPSH (Net Positive Suction Head) available at the inlet of the impeller. Use of larger diameter impellers (motor disks) to develop higher pump head requires use of larger and thicker case and structural components to contain the developed head pressure as well as the higher suction pressure required.

One way to reduce the size and weight of the pump casing and components, when high heads are required, is to use small diameter impellers operating at high speeds. However, smaller diameter impellers provide smaller available disk areas to house the permanent-magnet disk motor, thereby limiting the torque that can be developed by the motor. Another limitation is the relative unavailability of motor designs (magnetic rotors and stators) that can deliver a range of pressures and flow rates.

The foregoing illustrates limitations known to exist in present centrifugal pumps driven by permanent-magnet disk motors. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a two-stage, permanent-magnet, integral disk-motor centrifugal pump, comprising a housing having first and second suction ports and first and second discharge ports, said first discharge port being connected to said second suction port; a first impeller rotatably disposed on a shaft between the first suction port and the first discharge port and a second impeller placed back-to-back with said first impeller and rotatably disposed on a shaft between the second suction port and the second discharge port, each of said first and second impellers having a back shroud with an array of permanent magnets fixed thereto; a first stator and a second stator interposed between and adjacent to said first and second impellers, respectively; means for controlling rotational speed of said impellers; and means for extracting motor heat from the The foregoing and other aspects will become apparent from the following detailed description of the invention when considered in conjunction with the accompanying drawings.

DETAILED DESCRIPTION

Figure 1:
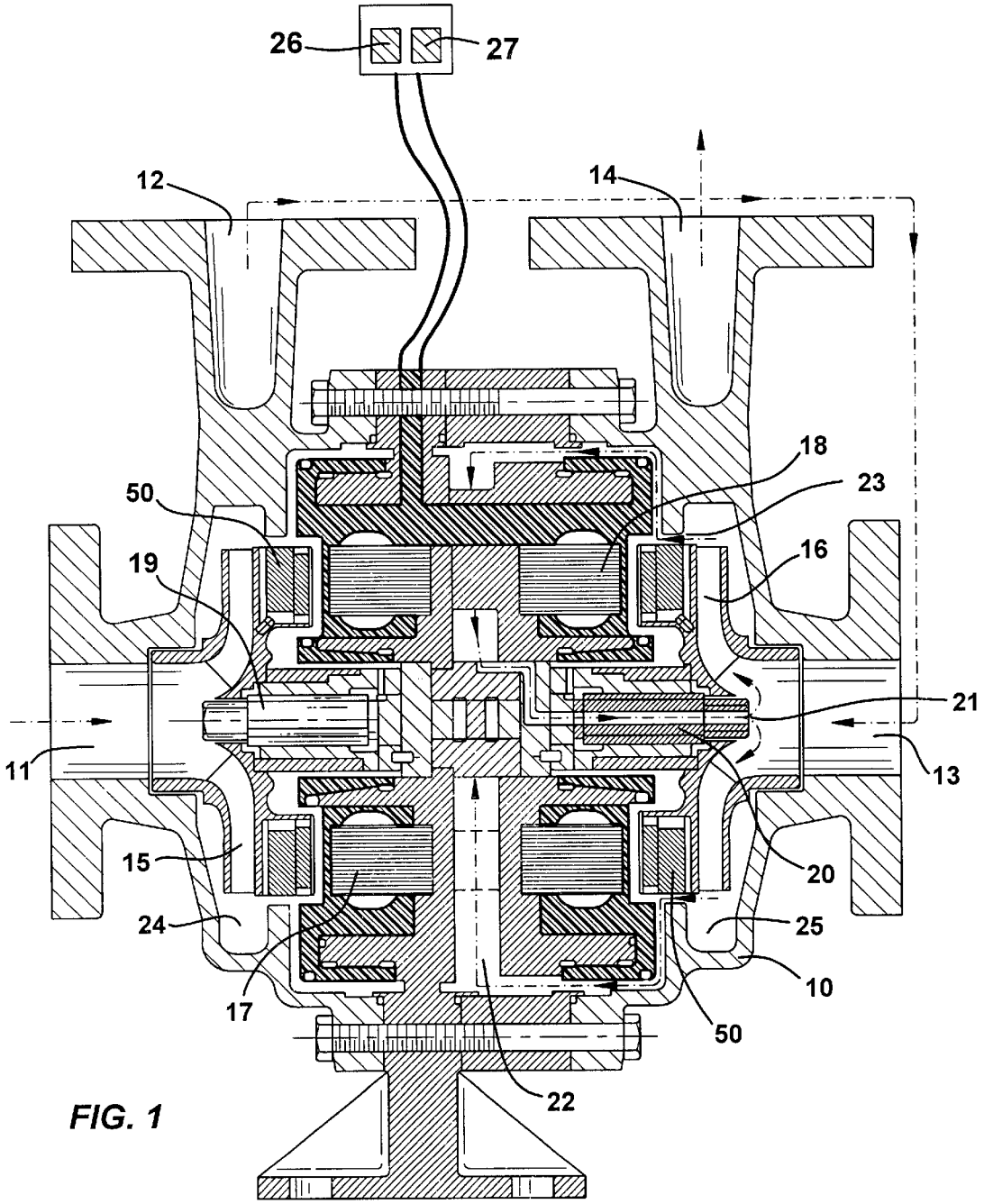
FIG. 1 is a schematic elevation axial section view of one embodiment of a two-stage centrifugal pump, according to the invention, in which the hydraulic design of each stage is optimized and in which a cooling path is provided from the second stage discharge, between the stators, and back to the second stage suction.

The embodiments illustrated in the Figures all have several common features; therefore, those common features will be described here with reference to FIGS. 1–4, and features specific to each embodiment will be discussed by reference to the applicable Figure. All of the embodiments include a pump housing 10 with a first suction port 11, a second suction port 13, a first discharge port 12, and a second discharge port 14. The first and second ports serving the first and second stages, respectively, of the pump. A first stage impeller 15 is rotatably mounted on a stationary shaft 19 between the first suction port 11 and the first discharge port 12 and is surrounded by a volute 24 for directing pumped fluid from the impeller 15 to the discharge 12. The second stage impeller 16 is rotatably disposed on a stationary shaft 20 within a volute 25 between the second stage suction port 13 and the second stage discharge 14. Each impeller 15, 16 has a circular array of permanent magnets 50 disposed on its back shroud in close proximity to a stator 17, 18, which is controlled by an invertor 26, 27 to drive the impeller. Motor heat is removed by cooling provisions in each embodiment.

FIG. 1 shows one embodiment of the two-stage pump of the invention, in which motor heat is extracted by pumped fluid which is bled from the volute 25 next to the second stage discharge port 14 through a bleed gap 23 around the impeller 16. The fluid passes around the second stage stator 18 and through a passage 22 between the first stage stator 17 and the second stage stator, then through a passage 21 in the hollow stationary shaft 20 to the second stage suction port 13. This controls the motor temperature very effectively but imposes a slight volumetric efficiency loss on the pump.

In this design, each impeller 15, 16 is of a different hydraulic design in order to optimize performance. There is a separate invertor 26, 27 for the first stage and the second stage, respectively.

Figure 2:
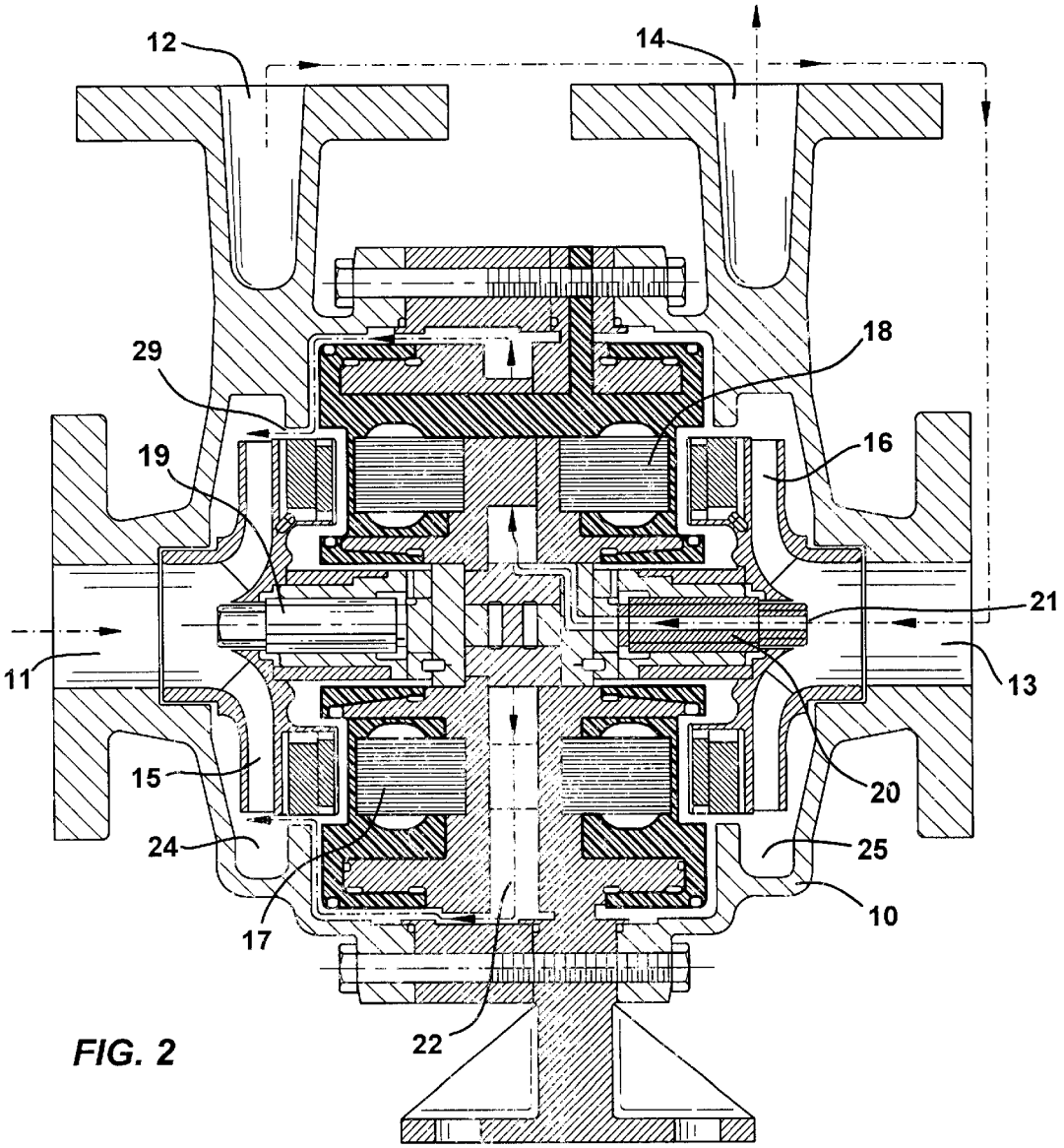
FIG. 2 is a schematic view, similar to that of FIG. 1, in which a cooling path with a decreased volumetric efficiency loss is provided from the second stage suction, through the hollow shaft, between the stators, and thence to the first stage volute.

FIG. 2 shows a pump similar to that of FIG. 1 in all respects, except for the cooling path. Here the pumped fluid is bled from the second stage suction port 13, through the passage 21 in the stationary shaft 20, between the first stage stator 17 and the second stage stator 18, around the first stage stator through the bleed gap 29 around the first stage impeller 15 into the first stage volute 24. This flow is driven by the differential pressure developed during diffusion of flow entering the first stage volute. Cooling performance is similar to that of the embodiment of FIG. 1 with a smaller volumetric efficiency loss. This embodiment also has impellers of different hydraulic design, as well as two separate invertors for driving the impellers at optimal speeds.

Figure 3A:
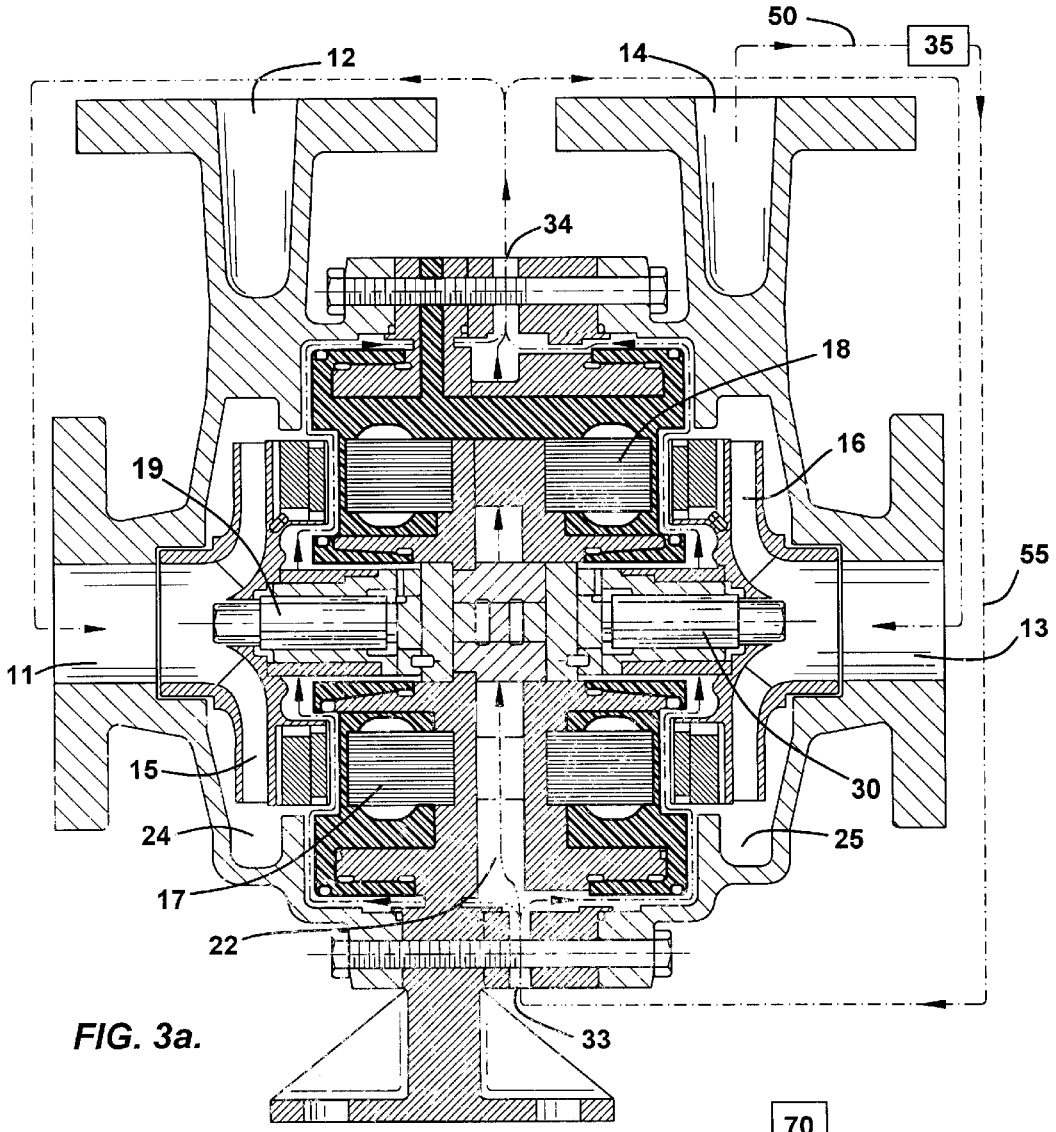
FIG. 3*a* is another schematic view, as in FIGS. 1 and 2, illustrating a cooling path through injection ports in the pump housing and between the stators.

The embodiment shown in FIG. 3 is mechanically the same as those of FIGS. 1 and 2, except for the solid stationary shaft 30 on which the second stage impeller 16 is rotatably mounted. Cooling of the motor is accomplished by a cooling loop which, as shown in FIG. 3*a*, may carry pumped fluid, and, in which case, extends from a take-off port at one of the two discharge ports, through a conduit 50, through a heat exchanger 35 (optional—only needed with hot fluid), through another conduit 55 and into an injection port 33 through the housing 10, between the stators 17, 18, and out through an extraction port 34 through the housing for return to the suction port 11, 13 of one of the two stages.

Figure 3B:
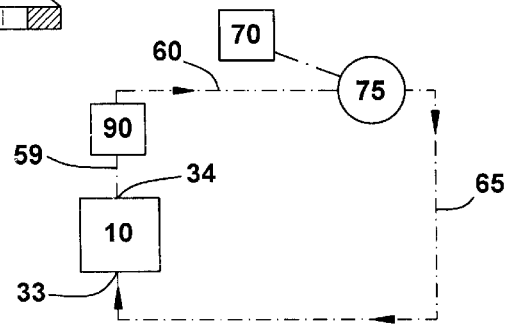
FIG. 3*b* is a fragmentary view showing an alternative motor cooling scheme which uses a separate coolant.

Alternatively, as seen in FIG. 3*b*, the external cooling loop may be a closed system (separated from the pumped fluid by sealing provisions) and may carry a cooling fluid which is incompatible with the pumped fluid. In such cases, the coolant is pumped by a pump 75 through a conduit 65 to the injection port 33 of the pump housing 10. The cooling path may extend through bearing cooling passages as well as between the stators. The coolant exits the housing through the extraction port 34 and is carried by a conduit 59 to a heat exchanger 90. The coolant exits the heat exchanger 90 and returns to the pump 75 by way of the return conduit 60. A reservoir 70 of coolant is provided to provide make-up fluid to the closed cooling system.

Figure 4:
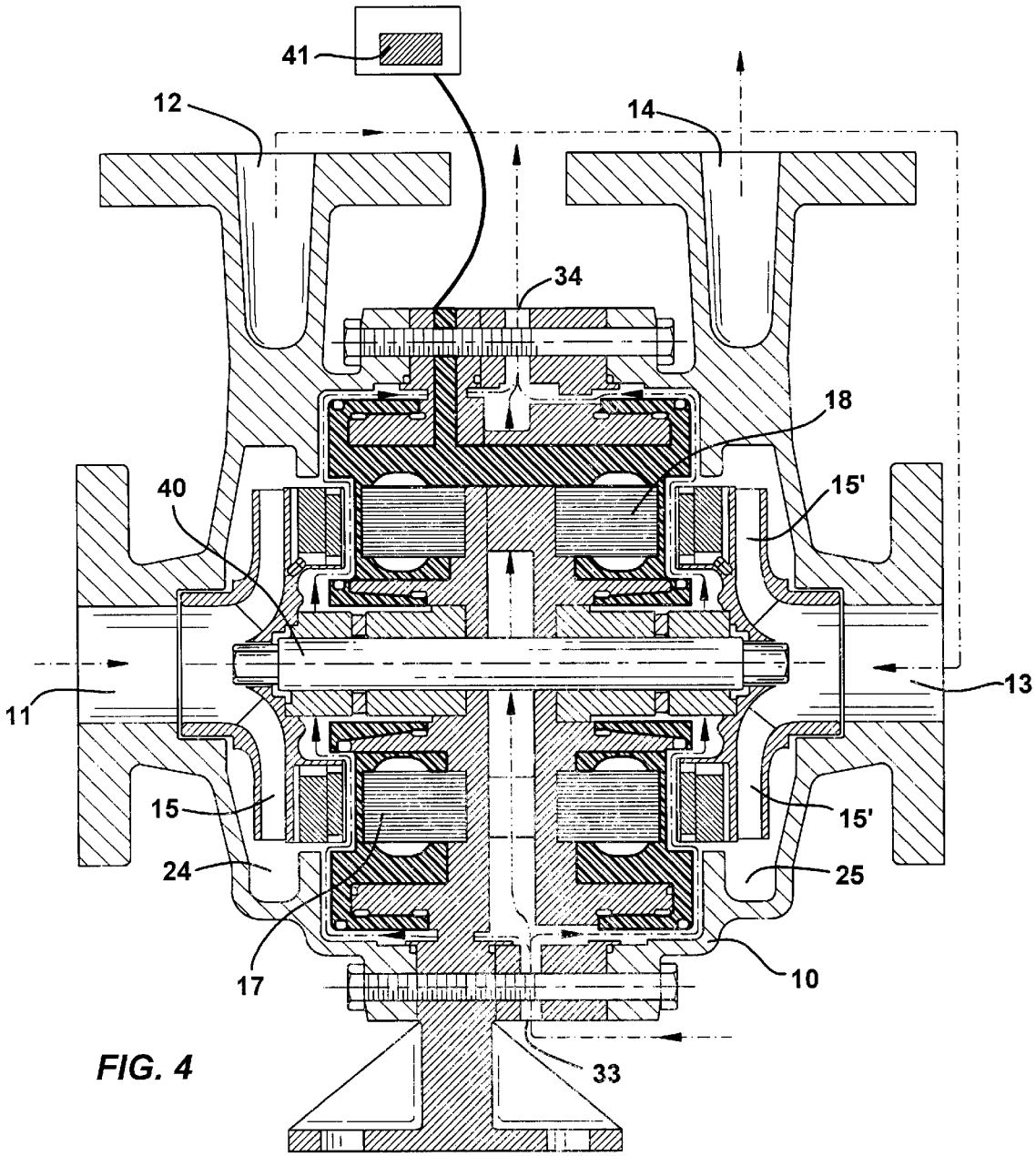
FIG. 4 is another embodiment of the invention in which both impellers are of the same hydraulic design, are mounted on a single rotatable shaft, and are driven by a single invertor.

FIG. 4 shows another embodiment of the two-stage pump of the invention, in which both stages have identical hydraulic design. The impellers 15, 15' are mounted on a single rotatable shaft 40, so they must turn together. In this case, with proper alignment of the impeller permanent magnets and stator phases, both stators 17, 18 may be controlled by a single common invertor 41 to drive both impellers 15, 15' at the same speed. In the alternative (not illustrated), one of the stages may be completely unpowered and may simply be driven by a more powerful permanent magnet array and stator combination on the other stage.

The invention disclosed here provides several options for a two-stage pump having impellers with integral permanent magnet disks on their back shrouds and being driven with stators controlled by one or two invertors. Removal of motor heat is accomplished by one of a variety of cooling systems using pumped fluid or a separate coolant/lubricant, the coolant circulating through either a completely internal or an internal/external cooling path. An external heat exchanger may also be employed, if necessary, to achieve proper cooling. In the case of a separate coolant/lubricant, a reservoir of make-up fluid and a circulating pump may also be employed for cooling the stators and cooling and lubricating the bearings.

Having described the invention, I claim:

1. A two-stage, permanent-magnet, integral disk-motor centrifugal pump, comprising:

a housing having first and second suction ports and first and second discharge ports, said first discharge port being connected to said second suction port;

a first impeller rotatably disposed on a shaft between the first suction port and the first discharge port and a second impeller placed back-to-back with said first impeller and rotatably disposed on a shaft between the second suction port and the second discharge port, each of said first and second impellers having a back shroud with an array of permanent magnets fixed thereto;

a first stator and a second stator interposed between and adjacent to said first and second impellers, respectively;

means for controlling rotational speed of said impellers; and means for extracting motor heat from the pump, said means comprising a cooling path through which working fluid is directed, said cooling path extending from the discharge of either one of the impellers, between the first and second stators, and back to the suction of either one of the impellers.

2. The centrifugal pump of claim 1, wherein the means for controlling rotational speed of said impellers comprises a single invertor which drives both impellers at a single speed.

3. The centrifugal pump of claim 1, wherein the means for controlling rotational speed of said impellers comprises two separate invertors each of which drives one impeller at a speed independent of the other.

4. The centrifugal pump of claim 3, wherein the first and second impellers are each of a different hydraulic design.

5. The centrifugal pump of claim 1, wherein the portion of the cooling path back to the suction of either one of the impellers comprises an axially extending bore through at least one of the shafts on which the impellers are disposed.

6. The centrifugal pump of claim 1, further comprising:

a working fluid take-off port through the housing at the discharge of at least one of the impellers;

a conduit extending from the take-off port to an injection port through the housing to provide fluid communication to the portion of the cooling path between the stators;

a return port through the housing between the stators; and a conduit extending from the return port to the suction of at least one of the impellers.

7. The centrifugal pump of claim 1, further comprising:

a heat exchanger, external to the pump housing, interposed between the discharge of said either one of impellers and the portion of the cooling path between the stators for cooling the working fluid.

8. The centrifugal pump of claim 1, further comprising:

a cooling path extending through cooling grooves in bearings supporting the impellers on the stationary shafts for cooling and lubricating said bearings.

9. A two-stage, permanent-magnet, integral disk-motor centrifugal pump, comprising:

a housing having first and second suction ports and first and second discharge ports, said first discharge port being connected to said second suction port;

a first impeller rotatably disposed on a shaft between the first suction port and the first discharge port and a second impeller placed back-to-back with said first impeller and rotatably disposed on a shaft between the second suction port and the second discharge port, each of said first and second impellers having a back shroud with an array of permanent magnets fixed thereto;

a first stator and a second stator interposed between and adjacent to said first and second impellers, respectively;

means for controlling rotational speed of said impellers; and means for extracting motor heat from the pump, said means comprising a reservoir of cooling fluid, a heat exchanger for cooling the cooling fluid, a circulating pump for said cooling fluid, and a closed cooling circuit for carrying said cooling fluid; said cooling circuit extending from the heat exchanger, between the stators, back to the reservoir of cooling fluid, and thence back to the heat exchanger; said pump being disposed at any point within the closed cooling circuit.

10. The centrifugal pump of claim 9, further comprising:

a cooling path extending through cooling grooves in bearings supporting the impellers on the stationary shafts for cooling and lubricating said bearings.

* * * * *